United States Patent [19]

Wood

[11] Patent Number: 4,641,469

[45] Date of Patent: Feb. 10, 1987

[54] PREFABRICATED INSULATING PANELS

[76] Inventor: Edward F. Wood, 258 Fairview Dr., Mundelein, Ill. 60060

[21] Appl. No.: 756,787

[22] Filed: Jul. 18, 1985

[51] Int. Cl.[4] ..... E04C 1/00; E04C 2/38

[52] U.S. Cl. ..... 52/309.12; 52/480; 52/509; 52/586; 52/742; 52/764; 52/828

[58] Field of Search ..... 52/309.12, 509, 764, 52/480, 586, 747, 828

[56] References Cited

U.S. PATENT DOCUMENTS

| | | | |
|---|---|---|---|
| 477,746 | 6/1892 | Elterich | 52/586 X |
| 496,544 | 5/1893 | Striesholm | 52/714 |
| 1,297,523 | 3/1919 | With . | |
| 1,379,882 | 5/1921 | Swartz . | |
| 1,807,630 | 6/1931 | McFarlin | 52/391 |
| 1,991,558 | 2/1935 | Keuls | 52/509 X |
| 2,008,192 | 7/1935 | Stubbs | 52/391 |
| 2,049,907 | 8/1936 | Hess . | |
| 2,898,258 | 8/1959 | Meier et al. . | |
| 3,159,882 | 12/1964 | Slayter . | |
| 3,381,437 | 5/1968 | Kidney | 52/586 |
| 3,401,494 | 9/1968 | Anderson . | |
| 3,952,470 | 4/1976 | Byrd, Jr. | 52/509 |
| 4,044,520 | 8/1977 | Barrows . | |
| 4,075,805 | 2/1978 | Bongiovanni . | |
| 4,157,640 | 6/1979 | Joannes | 52/309.12 |
| 4,170,859 | 10/1979 | Counihan | 52/391 X |
| 4,333,290 | 6/1982 | Koberstein . | |
| 4,438,611 | 3/1984 | Bryant . | |

FOREIGN PATENT DOCUMENTS

| | | | |
|---|---|---|---|
| 2503429 | 7/1976 | Fed. Rep. of Germany | 52/144 |
| 1182861 | 1/1959 | France | 52/586 |
| 7308975 | 1/1974 | Netherlands | 52/309.8 |
| 2053312 | 8/1980 | United Kingdom | 52/309.8 |

*Primary Examiner*—Alfred C. Perham
*Attorney, Agent, or Firm*—Barnes & Thornburg

[57] ABSTRACT

A building panel is provided having a channel in its back surface which matingly receives a rigidifying element. A fastener plate secures the panel to a substrate by slidable engagement with the rigidifying element.

27 Claims, 4 Drawing Figures

PREFABRICATED INSULATING PANELS

BACKGROUND AND SUMMARY OF INVENTION

The present invention relates to insulating exterior panels for buildings, and, in particular, to an improved reinforced panel and improved panel attachment arrangement.

Polystyrene exterior construction panels are commonly attached to a substrate or exterior surface of a building by means of adhesive. Mechanical retainers, such as bolts and screws, have been avoided where the panels actually form a structural element of the building because the panel flanges are typically too weak to retain them, especially if gun-shot through the panel into a concrete substrate. Merely employing a washer about a bolt fastener has been unsuccessful because the washers are exposed to air and "ghost" with respect to the panel as dirt collects at the washer-panel crevice. However, adhesive attachment methods require proper application by a skilled worker and are only available within a limited range of environmental conditions and a limited panel size. Also, such panels are not easily removable for replacement. Such attachment also provides no reinforcement to strengthen the polystyrene panels or to help prevent warping. Therefore, larger foam panels, which would simplify assembly and reduce construction time, cannot be used due to their inherent flexibility.

Other exterior construction panels have provided for attachment of a back bar adjacent or pressed into the polystyrene. However, such back bars are typically secured to the substrate by bolts or screws extending through to the interior surface of the substrate. It is usually desired for exterior panels to be affixed directly to exterior walls without having to coordinate attachment on the building interior in order to simplify the assembly process. Also, bolts and screws extending to the building interior provide undesirable thermal conductivity paths through the substrate and panel. Further, typical back bar arrangements will not support the panels straight off the wall nor sufficiently resist strong winds, and replacement requires removal of the entire bolted assembly from the substrate.

Another panel arrangement has employed a U-shaped channel bracket having teeth pressed into the face of an insulating panel. This panel is attached to the building wall by separate L-shaped fasteners extending from the face of the panel down to the wall surface. Typically, the panel arrangement and fasteners are then covered with another layer which actually serves as the exterior face. Without such an extra covering over the entire panel arrangement, these brackets would provide paths of thermal conductivity which significantly reduce the insulating effect of the panels.

It is, therefore, an object of the present invention to provide an improved insulating building panel.

Another object of the present invention is the provision of a method of securing an insulating panel to a building exterior without creating excessive thermal conductivity paths through the panel to the building wall.

Still another object of the present invention is to provide a simplified means of attaching structural building panels to wall surfaces.

Yet another object of the present invention is the provision of an arrangement for increasing rigidity and structural integrity of exterior building panels.

Yet still another object of the present invention is to provide a readily replaceable building panel having decreased production costs and installation time.

These and other objects of the present invention are achieved through an insulating foam building panel having a channel extending across its back surface with a rigidifying element inserted therein. A fastener is attached to the substrate wall surface, and the rigidifying element is slidably received onto each side of that fastener. When the panels are properly positioned, the fastener is tightened to the wall to fixedly secure the panels to the building exterior. The channel is preferably formed with flanged grooves to retain complementary flanges on the rigidifying element.

Other objects, advantages and novel features of the present invention will become readily apparent from the following detailed description of the invention when considered in conjunction with the accompanying drawings.

DETAILED DESCRIPTION OF THE DRAWINGS

Figure 1:
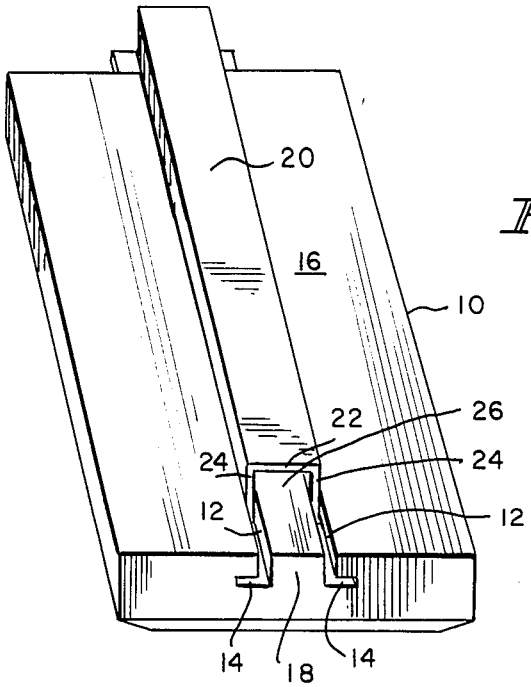
FIG. 1 is a perspective view from the back of a construction panel according to the present invention showing the rigidifying element partially disposed within the retaining channels.

FIG. 1, which illustrates a preferred embodiment of the present invention, shows the back surface 16 of a panel 10. A plurality of these panels are attachable to an exterior wall of a building to form an independent, insulating structural surface capable of directly withstanding a wide range of environmental conditions and shielding the building wall. The panels themselves create the weather surface and do not require any additional covering.

Panel 10 includes channels 12 extending longitudinally entirely across back surface 16. Preferably, channels 12 are each L-shaped and oppositely facing such that lateral channel portions 14 project outwardly to the longitudinal sides of panel 10. Rigidifying element 20 is provided for insertion into channels 12. Rigidifying element 20 is, for example, a flanged U-channel or C-channel extrusion having a bight 22 and L-shaped legs 24. Legs 24 are formed so as to be matingly received within channels 12. Rigidifying element 20 is preferably attached to panel 10 by sliding insertion from one end of channels 12.

Where panel 10 is employed to provide building insulation, it has been found to be especially advantageous to form that panel from a polystyrene foam material. Hot wire cutting techniques to create channels 12 will leave central area 18 intact. Central area 18 assists in supporting and positively locating rigidifying element 20. Also, leaving area 18 intact when cutting grooves 12 avoids weakening the structural integrity of panel 10. In embodiments where it is desirable to have rigidifying element 20 lie flush with back surface 16, an upper portion of area 18, corresponding with the thickness of bight 18, can be removed.

Although the exposed front and side surfaces of individual panels 10 are typically coated with an acrylic base coating or a cementitious material, panel arrangements according to the present invention do not require further reinforcement from, for example, laminated overcoatings. In fact, due to the particular attachment of rigidifying element 20, the present invention permits less rigid panel materials to be employed. For example, previous panel arrangements have been limited to panel sizes of less than four square feet (front surface) because of the inherent flexibility and warping of foam panels. With the present invention, foam panels of almost any size can be employed, thereby significantly reducing both production costs and installation time. Where a given panel provides a particularly large surface and/or where particularly flexible panel material is employed, a plurality of generally parallel and spaced apart rigidifying elements are attached to the back side of panel 10 through a corresponding plurality of channels, according to the present invention.

Figure 2:
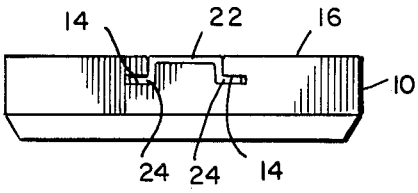
FIG. 2 is a lateral side view of an embodiment of the construction panel according to the present invention wherein the rigidifying element lies flush with the back surface of the panel when inserted within the retaining channels.

Panel 10 is attached to a building surface or wall by means of a mounting plate 28 at each end of rigidifying element 20. Mounting plate 28 is, for example, formed as a flat strip with a portion 32 matingly receivable between legs 24 of rigidifying element 20. Where rigidifying element 20 does not extend beyond the lateral sides of panel 10 and the back surface of bight 22 does not lie flush with back surface 16 of panel 10 because the height of legs 24 is greater than the depth of channels 12 by more than the thickness of bight 22, a recess 26 is created between the inside surface of bight 22 and the surface of central area 18. Portion 32 of mounting plate 28 is slidably receivable within recess 26. Alternatively, where, as shown in FIG. 2, rigidifying element 20 does not extend beyond the lateral sides of panel 10 and the back surface of bight 22 does lie flush with back surface 16, sliding engagement of mounting plate 28 between legs 24 causes localized compression of the panel at central area 18. This compression can assist in the structural integrity of the rigidifying element-panel connection.

Figure 3:
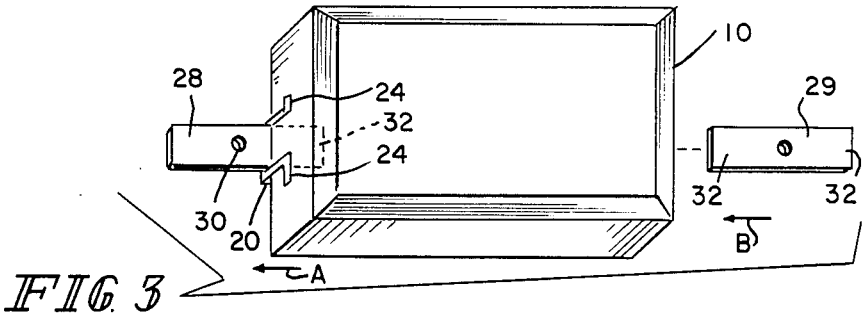
FIG. 3 is a front view of the construction panel of FIG. 1 as the arrangement is attached to a fastener element on a substrate wall.

As shown in FIG. 3, panel 10 is fastened to a building surface (not shown) by first loosely securing mounting plate 28 to the building by a bolt or screw fastener 30. This initial placement permits mounting plate 28 to be spaced from the building surface by a distance greater than the thickness of bight 22. One lateral side of panel 10 is then slid, in the direction of arrow A, onto portion 32 of mounting plate 28 that is matingly receivable between legs 24. In this manner, panel 10 is positively located on the building surface. Next, a second mounting plate 29 is slid, in the direction of arrow B, between legs 24 on the opposite lateral side of panel 10. This second mounting plate is then loosely secured to the building surface by a bolt or screw fastener (not shown) in the same manner as first mounting plate 28.

Where mounting plates 28 and 29 are not employed at the outside edge of the overall panel arrangement, the mounting plate is preferably formed with a plurality of portions 32. Thus, a second panel 10 (not shown) is subsequently slid onto another portion 32 of mounting plate 29 such that a series of panels is assembled side by side in a given overall arrangement. Likewise, where each panel includes a plurality of rigidifying elements 20, a plurality of mounting plates will secure each lateral side of each panel.

Once all the mounting plates for a given panel are in place to secure that panel, the corresponding bolt or screw fasteners for those plates are tightened down toward the substrate wall so that the panel is held rigidly in place. With the present invention, an extremely narrow gap is achieved between the panels. Such close alignment of adjacent panels has been found to be highly desirable for decorative purposes. The width of the gap is determined only by the tool necessary to tighten the mounting plate fasteners. After all panels are finally secured in place, these gaps are, for example, caulked to create a complete thermal barrier with respect to the underlying building wall. Thus, even though the rigidifying elements, mounting plates and fasteners are constructed of thermally conductive metals, since there is no exposure of these elements to the ambient atmosphere, thermal losses to building interior hearing and cooling systems are significantly reduced.

The arrangement of the present invention is especially versatile. Mounting plates 28 and 29 provide a secure base to receive gun-shot fasteners. Side mounting of the panels permits the fasteners to attach to the exterior mounting plates from either the inside or the outside of the building, without perforating the insulating panel itself. Thus, brittle panel materials can be safely employed.

In the event that a panel is damaged or needs replacement, bolt fasteners are readily loosened or removed from the mounting plates and the specific panel thereby extracted without destruction plates and the specific panel thereby extracted without destruction of the overall panel arrangement. In addition, panel assemblies of the present invention can easily be pre-fabricated and delivered to the work site with the rigidifying elements already in place within the panels. Likewise, such panel arrangements are distributable as kits suitable for application in standard building dimensions.

Figure 4:
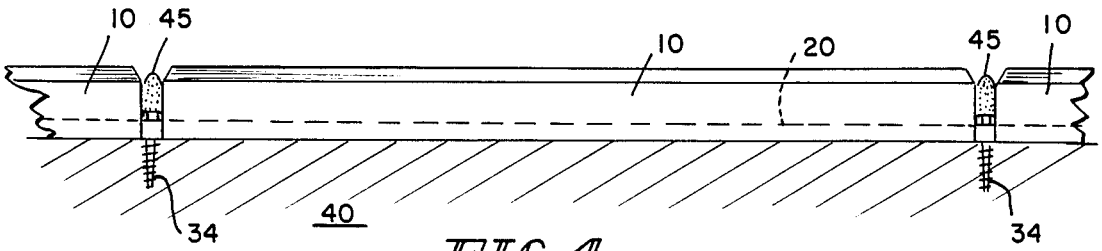
FIG. 4 is a longitudinal side view of another embodiment of the present invention for attachment of construction panels to a substrate wall.

FIG. 4 illustrates another embodiment of the present invention which is especially adapted for repair of pre-existing panel arrangements and assembly of larger pre-fabricated constructions. Rigidifying element 20 includes flanged legs to support a given panel, but also extends longitudinally into and through a number of adjacent panels. Thus, where multiple smaller panels are desired for decorative purposes, an entire wall (or significant portion thereof) can be assembled at the manufacturing facility on relatively few individual rigidifying elements. These multi-panel units are securable to building structure 40 by fasteners 34 passing directly through the rigidifying elements where the rigidifying elements extend between the individual panels mounted thereon. Again, the gaps created by such fastenings are subsequently filled with caulking 45 to create thermal barriers and prevent any longitudinal movement of the panels along the rigidifying elements.

At the outside edges of the multi-panel units the rigidifying elements are securable by mounting plates or again directly through extensions past the lateral panel sides. Conventional corner and edge caps can then be applied to the finished panel arrangement.

From the preceding description of the preferred embodiments, it is evident that the objects of the present invention are attained. Although the invention has been described and illustrated in detail, it is to be clearly understood that the same is by way of illustration and example only and is not to be taken by way of limitation. The spirit and scope of the invention are defined only by the terms of the appended claims.

What is claimed is:

1. An exterior insulation panel comprising:

a panel body having front, back, longitudinal side and lateral side surfaces;

at least one preformed channel into said back surface of said panel extending from one side surface to another side surface, said preformed channel including a first portion projecting through said panel from said back surface toward said front surface and a second portion continuous with said first portion projecting within said panel toward at least one of said side surfaces other than those between which the channel extends;

a flanged rigidifying means for strengthening said panel body which is slidably and matingly disposed within and extending substantially along the length of said channel, said rigidifying means also including means for structurally supporting said panel on the exterior surface of a building.

2. A panel as in claim 1, wherein said panel body is a foam insulating material.

3. A panel as in claim 2, wherein said panel body is coated with a cementitious facing on said front, longitudinal side and lateral side surfaces.

4. A panel as in claim 3, wherein said channel includes two L-shaped grooves cut into the back surface of said panel body.

5. A panel as in claim 4, wherein said grooves are spaced and said L-shaped grooves face opposite longitudinal sides.

6. A panel as in claim 4, wherein said rigidifying means is a metallic extrusion.

7. A panel system comprising:

a panel body having front, back, longitudinal side and lateral side surfaces;

at least one channel into said back surface of said panel body parallel to said longitudinal side and extending from one lateral side to the other;

a rigidifying means for strengthening said body panel disposed within said channel;

a fastening means to be mounted to a substrate for affixing said panel to said substrate, said fastening means slidingly engaging said panel between said rigidifying means and said panel body.

8. A panel system as in claim 7, wherein said panel body is a foam insulating material.

9. A panel system as in claim 8, wherein said panel body is coated with a cementitious facing on said front, longitudinal side and lateral side surfaces.

10. A panel system as in claim 9, wherein said fastening means is a flat plate and fastener.

11. A panel system comprising:

a panel body having front, back, longitudinal side and lateral side surfaces, said panel body being formed of a foam insulating material and coated with a cementitious facing on said front, longitudinal side and lateral side surfaces;

at least one channel into said back surface of said panel body parallel to said longitudinal side and extending from one lateral side to the other;

a rigidifying means for strengthening said body panel disposed within said channel; and a fastening means to be mounted to a substrate for affixing said panel to said substrate by slidingly engaging said rigidifying means, said fastening means includes a flat plate and fastener wherein said plate is disposed between said rigidifying means and said panel body channel, the surface area about said channel being free of said cementitious coating and said surface area being deformed beneath said rigidifying means by said plate.

12. A panel system as in claim 11, wherein said plate is bolted to a substrate.

13. A panel system as in claim 12, wherein said plate engages two adjacent panels.

14. A panel system as in claim 13, including caulking between adjacent panel bodies.

15. A method of affixing a panel comprising:

first forming a channel in a back surface of a panel body, said channel including a portion within the panel body which extends laterally with respect to the the length of the channel;

slidably inserting a flanged rigidifying means for strengthening said panel body into said channel;

applying a fastening means to a substrate; slidably engaging said fastening means with respect to said rigidifying means for affixing said panel onto said substrate.

16. A method as in claim 15, wherein said fastening means is applied to said substrate from a back side of said panel.

17. A method as in claim 15, wherein said fastening means is applied to said substrate from a front side of said panel.

18. A method as in claim 17, wherein said fastening means is bolted to said substrate.

19. A method as in claim 15, including wire cutting said channels into said panel body, wherein said channels are two oppositely facing L-shaped grooves.

20. A method as in claim 19, wherein said rigidifying means has oppositely facing integral L-shaped flanges and slides into said L-shaped grooves.

21. A method of affixing a panel comprising:

forming channels in a back surface of a panel body by wire cutting, said channels including two oppositely facing L-shaped grooves;

inserting a rigidifying means for strengthening said panel body into said channel, said rigidifying means having oppositely facing integral L-shaped flanges and being slidably disposed within said L-shaped grooves; and applying a fastening means to a substrate and sliding said panel onto said fastening means to affix said panel onto said substrate, said fastening means including a plate which slides in between said rigidifying means and the channel area of said panel body, wherein said channel area is free of cementitious material and said plate deforms an area of said panel body channel in between said rigidifying means.

22. A method as in claim 21, including sliding an adjacent panel onto said plate.

23. A method as in claim 22, including caulking between adjacent panels.

24. An exterior insulating construction panel, applied to a building surface as an independent unit, comprising:

a panel member having at least one preformed channel across a surface of said panel member, a portion of said channel extending into said panel member at an angle with respect to said panel surface;

a rigidifying member matingly received within said panel member so as to provide structural rigidity and support for said panel member; and fastening means matingly received within said rigidifying member for securing said panel member to said building surface without creating a thermally conductive path from ambient atmosphere to said building surface.

25. In an exterior structural construction, for insulating a building surface, formed from a plurality of independent structural units each having an exposed exterior face and being mounted directly to said building surface, the improvements being said unit construction and mounting arrangement to said building surface, comprising:

a preformed channel formed across a first surface of each of said units which is to be directly adjacent said building surface, said channel extending inwardly from said first surfaces, partially through said units and at an angle from the surface normal;

a rigidifying element matingly received and co-extensive within said channel with respect to said units so as to provide structural rigidity and support for each of said units; and fastener means cooperatively associated with and for securing said rigidifying element to said building surface without creating a thermally conductive path through said untis from said exterior said to said building surface.

26. A construction panel applied to a building surface comprising:

a panel body having a plurality of spaced apart channels previously formed within one surface thereof, at least one of said channels having a first portion projecting from said surface into said panel body and a second portion continuous with the first portion and extending laterally within said panel body; and rigidifying means for strengthening said panel body received within said channels and slidable along the length of said channels, said rigidifying means including a first portion bridging said channels and a flanged second portion coextensive with said second portion of said channel, and said rigidifying means including means for structurally supporting said panel body.

27. The contruction panel according to claim 21 wherein the portion of said panel body about said channels is formed from foamed material and application of said construction panel to said building surface by said structurally supporting means results in slight compression of said foam material.

* * * * *